US012577699B2

(12) United States Patent
Tomita et al.

(10) Patent No.: US 12,577,699 B2
(45) Date of Patent: Mar. 17, 2026

(54) METHOD OF LIQUID MANAGEMENT IN ANODE CHAMBER AND APPARATUS FOR PLATING

(71) Applicant: EBARA CORPORATION, Tokyo (JP)

(72) Inventors: Masaki Tomita, Tokyo (JP); Yasuyuki Masuda, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 485 days.

(21) Appl. No.: 18/026,805

(22) PCT Filed: Jun. 20, 2022

(86) PCT No.: PCT/JP2022/024506
§ 371 (c)(1),
(2) Date: Mar. 16, 2023

(87) PCT Pub. No.: WO2023/248286
PCT Pub. Date: Dec. 28, 2023

(65) Prior Publication Data

US 2024/0318347 A1 Sep. 26, 2024

(51) Int. Cl.
*C25D 21/04* (2006.01)
*C25D 3/38* (2006.01)
(Continued)

(52) U.S. Cl.
CPC ..... *C25D 21/14* (2013.01); *C25D 3/38* (2013.01); *C25D 21/18* (2013.01)

(58) Field of Classification Search
None
See application file for complete search history.

(56) References Cited

U.S. PATENT DOCUMENTS 6,821,407 B1 * 11/2004 Reid ..... C25D 17/002 204/252
2007/0114127 A1 5/2007 Uchiumi
(Continued)

FOREIGN PATENT DOCUMENTS

JP H04-210492 A 7/1992
JP H09-264000 A 10/1997
(Continued)

OTHER PUBLICATIONS

English translation DE 102013112302 (Year: 2013).*

*Primary Examiner* — Stefanie S Wittenberg
(74) *Attorney, Agent, or Firm* — BakerHostetler

(57) ABSTRACT

There is provided a method of liquid management in an anode chamber. The method comprises providing a plating tank that comprises an anode; a barrier membrane placed to come into contact with or to be brought into close contact with an upper face of the anode; a cathode chamber on an upper side and an anode chamber on a lower side parted by the barrier membrane; and an exhaust path provided to communicate with the anode chamber and configured to discharge bubbles from the anode chamber to outside of the plating tank; storing a plating solution in the anode chamber and in the cathode chamber, such that a liquid level of the plating solution in the exhaust path that is a liquid level of the plating solution in the anode chamber is lower than a liquid level of the plating solution in the cathode chamber; determining whether the liquid level of the plating solution in the exhaust path is lower than a predetermined height, based on an output of a liquid level sensor placed in the exhaust path; and supplying pure water or an electrolytic solution to the anode chamber, when it is determined that the liquid level of the plating solution in the exhaust path is lower than the predetermined height.

11 Claims, 10 Drawing Sheets

(51) Int. Cl.
*C25D 21/14* (2006.01)
*C25D 21/18* (2006.01)

(56) References Cited

U.S. PATENT DOCUMENTS

| | | | | |
|---|---|---|---|---|
| 2012/0138471 | A1 | 6/2012 | Mayer et al. | |
| 2019/0309436 | A1 | 10/2019 | Shimoyama et al. | |
| 2020/0017989 | A1 | 1/2020 | Banik, II et al. | |
| 2020/0270759 | A1* | 8/2020 | Banik | C25D 5/08 |
| 2022/0307153 | A1 | 9/2022 | Kanda et al. | |

FOREIGN PATENT DOCUMENTS

| | | | |
|---|---|---|---|
| JP | 2007-299547 | A | 11/2007 |
| JP | 4822858 | B2 | 11/2011 |
| JP | 2014-234538 | A | 12/2014 |
| JP | 2017-125251 | A | 7/2017 |
| JP | 2020-056093 | A | 4/2020 |
| JP | 2020-200502 | A | 12/2020 |
| JP | 2021-110017 | A | 8/2021 |
| JP | 6951609 | B1 | 10/2021 |
| KR | 10-2213335 | B1 | 2/2021 |
| KR | 10-2345922 | B1 | 1/2022 |
| WO | WO 2022/144985 | A1 | 7/2022 |

* cited by examiner

METHOD OF LIQUID MANAGEMENT IN ANODE CHAMBER AND APPARATUS FOR PLATING

CROSS-REFERENCE TO RELATED APPLICATIONS

This application is a U.S. national phase application of International Patent Application No. PCT/JP2022/024506 filed Jun. 20, 2022, which is incorporated by reference in its entirety for any and all purposes.

TECHNICAL FIELD

The present disclosure relates to a method of liquid management in an anode chamber or more specifically a method of liquid management in an anode chamber of an apparatus for plating, as well as an apparatus for plating.

BACKGROUND ART

A plating apparatus as described in U.S. Patent Application Publication No. 2020-0017989 (PTL 1) has been known as a plating apparatus configured to perform plating of a substrate such as a semiconductor wafer. The plating apparatus includes a plating tank configured to store a plating solution therein and provided with an anode placed therein; a substrate holder configured to hold a substrate as a cathode such as to be opposed to the anode; and a barrier membrane placed between the anode and the substrate holder to part inside of the plating tank into an anode chamber and a cathode chamber. The plating apparatus of this configuration causes the plating solution to flow along a surface of the substrate. The barrier membrane is placed below a frame fixed in the plating tank. When a pressure in the cathode chamber becomes higher than a pressure in the anode chamber, the barrier membrane is separated from the frame to be extended downward and is likely to form a pocket for trapping bubbles between the frame and the barrier membrane. In order to prevent such a phenomenon, the apparatus described in U.S. Patent Application Publication No. 2020-0017989 (PTL 1) is configured to regulate the supply of the plating solution into the anode chamber such that the pressure in the anode chamber becomes or is kept higher than the pressure in the cathode chamber and thereby prevents the barrier membrane from being extended downward.

CITATION LIST

Patent Literatures

PTL1: US Patent Application Publication No. 2020-0017989

SUMMARY OF INVENTION

Technical Problem

In a structure of causing a barrier membrane (membrane) to be brought into close contact with an anode like a plating module described in [International Patent Application No. PCT/JP2022/016809] filed by the applicant of the present disclosure, in order to assure that the barrier membrane is brought into close contact with the anode by a pressure difference between a cathode chamber and an anode chamber, a control is required to keep the liquid level of a plating solution in the anode chamber (anode solution) lower than the liquid level of a plating solution in the cathode chamber (cathode solution). It is also required to prevent depletion of the anode solution.

By taking into account the foregoing, one object of the present disclosure is to control the liquid level of an anode solution to be lower than the liquid level of a cathode solution and to prevent reduction or depletion of the anode solution in an apparatus for plating.

Solution to Problem

According to one aspect, there is provided a method of liquid management in an anode chamber. The method comprises providing a plating tank that comprises an anode; a barrier membrane placed to come into contact with or to be brought into close contact with an upper face of the anode; a cathode chamber on an upper side and an anode chamber on a lower side parted by the barrier membrane; and an exhaust path provided to communicate with the anode chamber and configured to discharge bubbles from the anode chamber to outside of the plating tank; storing a plating solution in the anode chamber and in the cathode chamber, such that a liquid level of the plating solution in the exhaust path that is a liquid level of the plating solution in the anode chamber is lower than a liquid level of the plating solution in the cathode chamber; determining whether the liquid level of the plating solution in the exhaust path is lower than a predetermined height, based on an output of a liquid level sensor placed in the exhaust path; and supplying pure water or an electrolytic solution to the anode chamber, when it is determined that the liquid level of the plating solution in the exhaust path is lower than the predetermined height.

DESCRIPTION OF EMBODIMENTS

Figure 1:
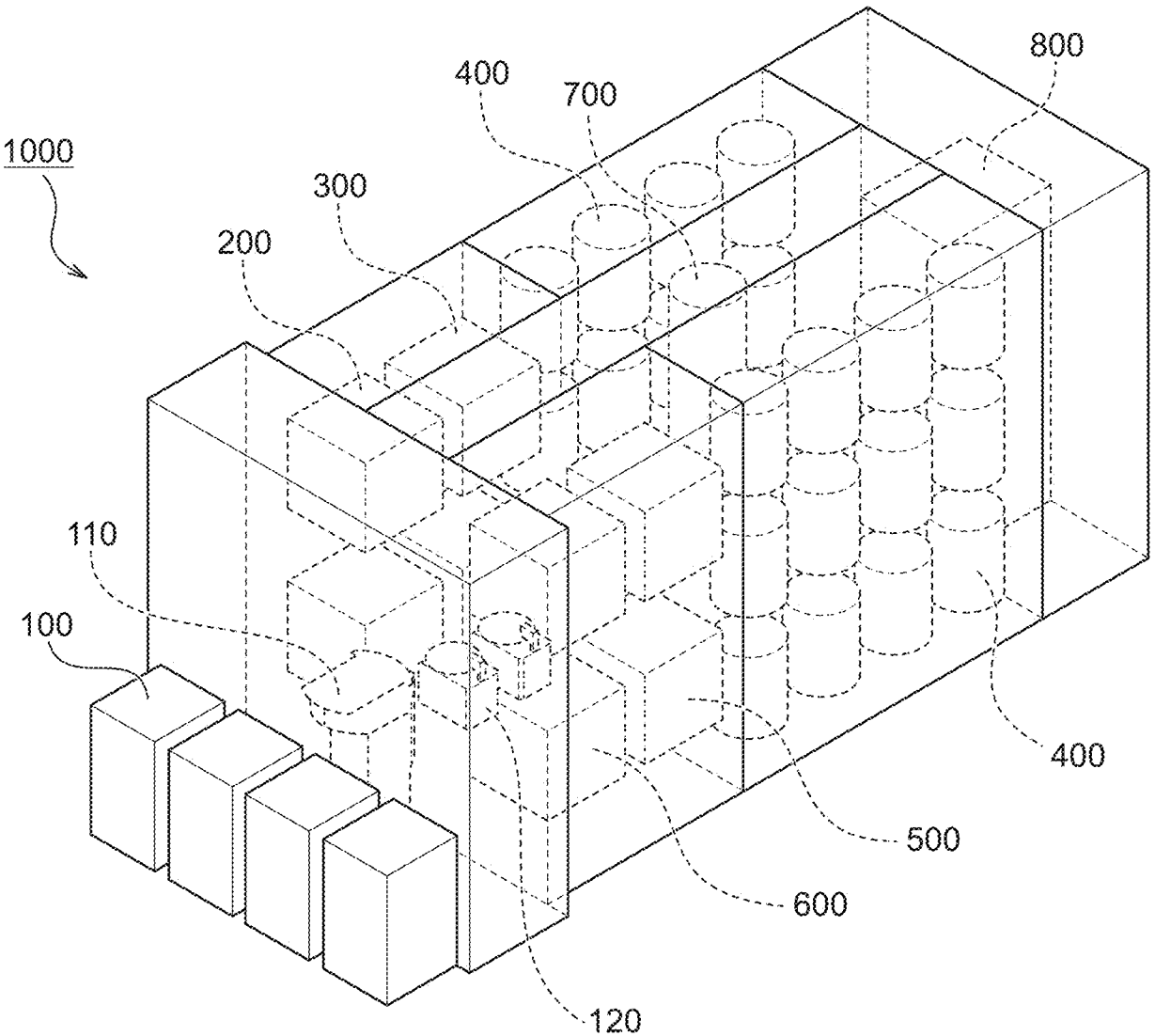
FIG. 1 is a perspective view illustrating the overall configuration of a plating apparatus according to one embodiment.

The following describes a plating apparatus 1000 according to one embodiment of the present disclosure with reference to drawings. The drawings are schematically illustrated, in order to facilitate understanding the features of substances. The ratio of dimensions of respective components and the like in the drawings may not be equal to those in the actual state. Cartesian coordinates X-Y-Z are illustrated in some of the drawings for the purpose of reference. In the Cartesian coordinates, a Z direction corresponds to an upward direction, and a −Z direction corresponds to a downward direction (direction where the gravity acts).

First Embodiment

Figure 2:
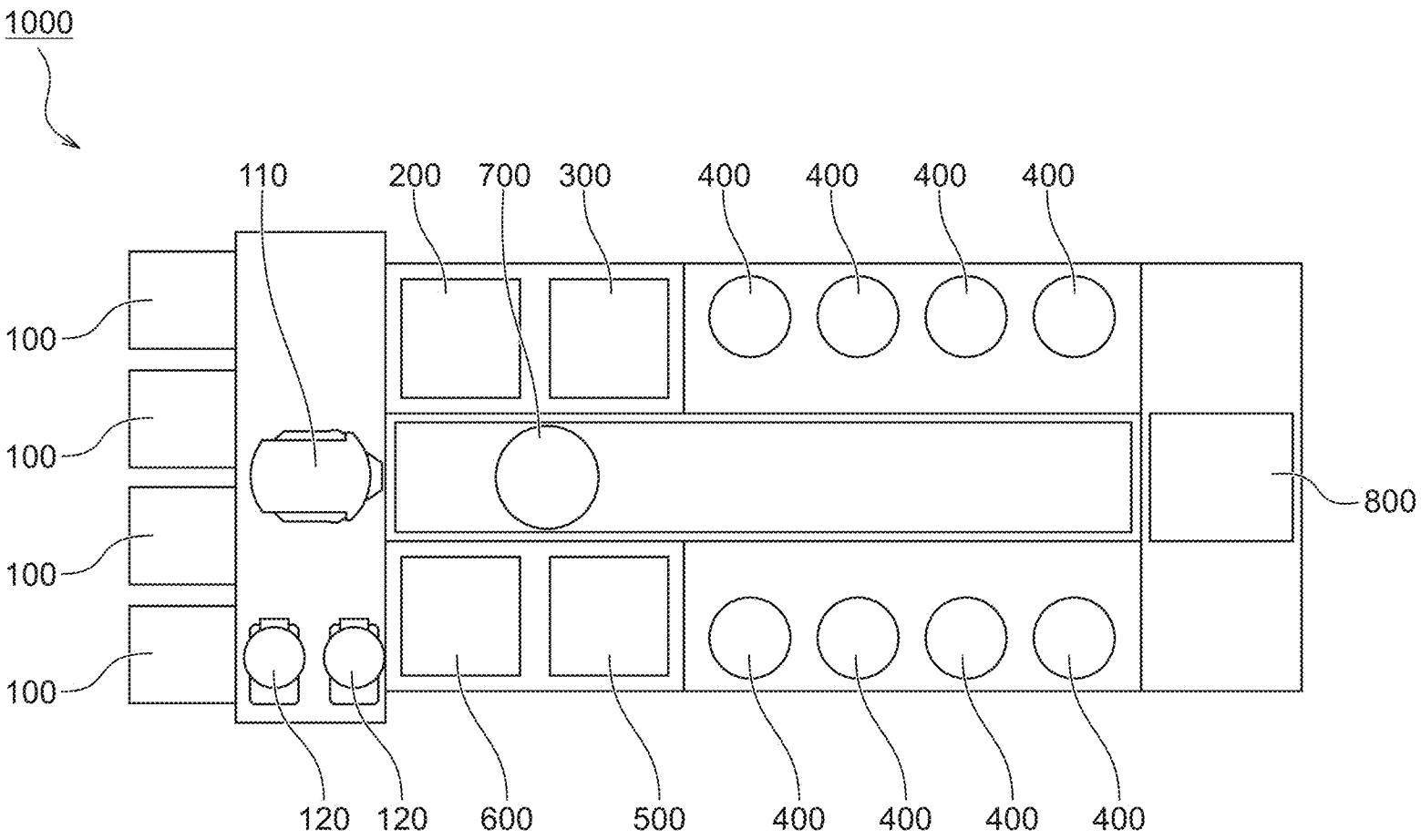
FIG. 2 is a plan view illustrating the overall configuration of the plating apparatus according to the embodiment.

FIG. 1 is a perspective view illustrating the overall configuration of the plating apparatus of this embodiment. FIG. 2 is a plan view illustrating the overall configuration of the plating apparatus of this embodiment. As illustrated in FIGS. 1 and 2, a plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, the pre-wet module 200, and the spin rinse dryers 600. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on, a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers are disposed to be arranged in the vertical direction in this embodiment, the number of spin rinse dryers and arrangement of the spin rinse dryers are arbitrary. The transfer device 700 is a device for transfer the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the pre-wet module 200.

The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer robot 110 receives the substrate from the spin rinse dryer 600 and transfers the substrate, on which the drying process is performed, to the cassette at the load port 100. Finally, the cassette housing the substrate is unloaded from the load port 100.

The configuration of the plating apparatus 1000 illustrated in FIG. 1 and FIG. 2 is only one example, and the configuration of the plating apparatus 1000 is not limited to the configuration of FIG. 1 and FIG. 2.

The control module 800 has, for example, a CPU and a volatile memory and/or a non-volatile memory. The memory is also referred to as a storage medium or a recording medium. The memory stores therein various programs, various parameters and the like. The CPU reads out the various programs, the various parameters and the like and executes the various programs.

Plating Module

The following describes the plating module 400. The plurality of plating modules 400 included in the plating apparatus 1000 of the embodiment have similar configurations. Accordingly the description regards one plating module 400.

Figure 3:
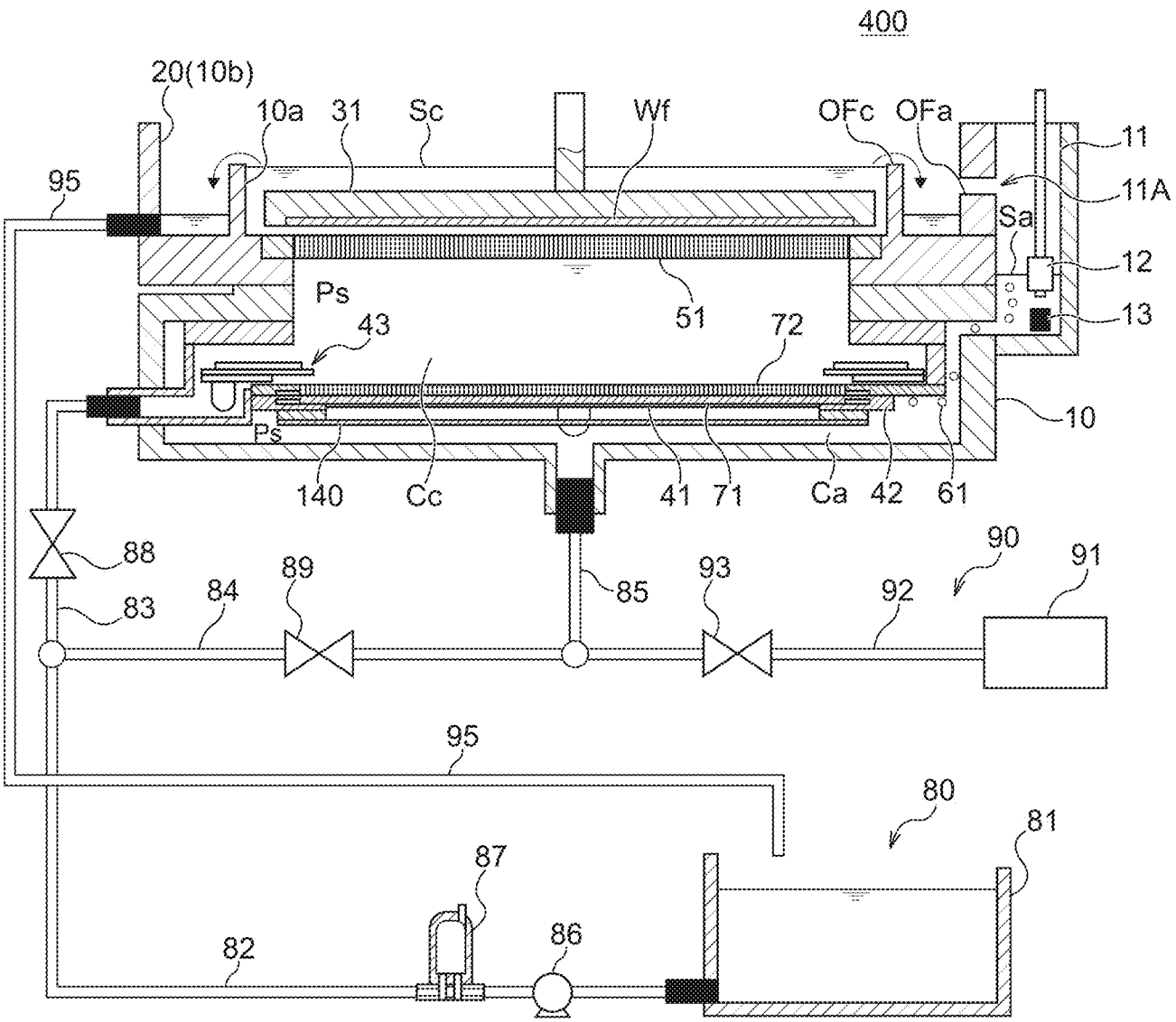
FIG. 3 is a sectional view illustrating the configuration of a plating module according to one embodiment.
Figure 4:
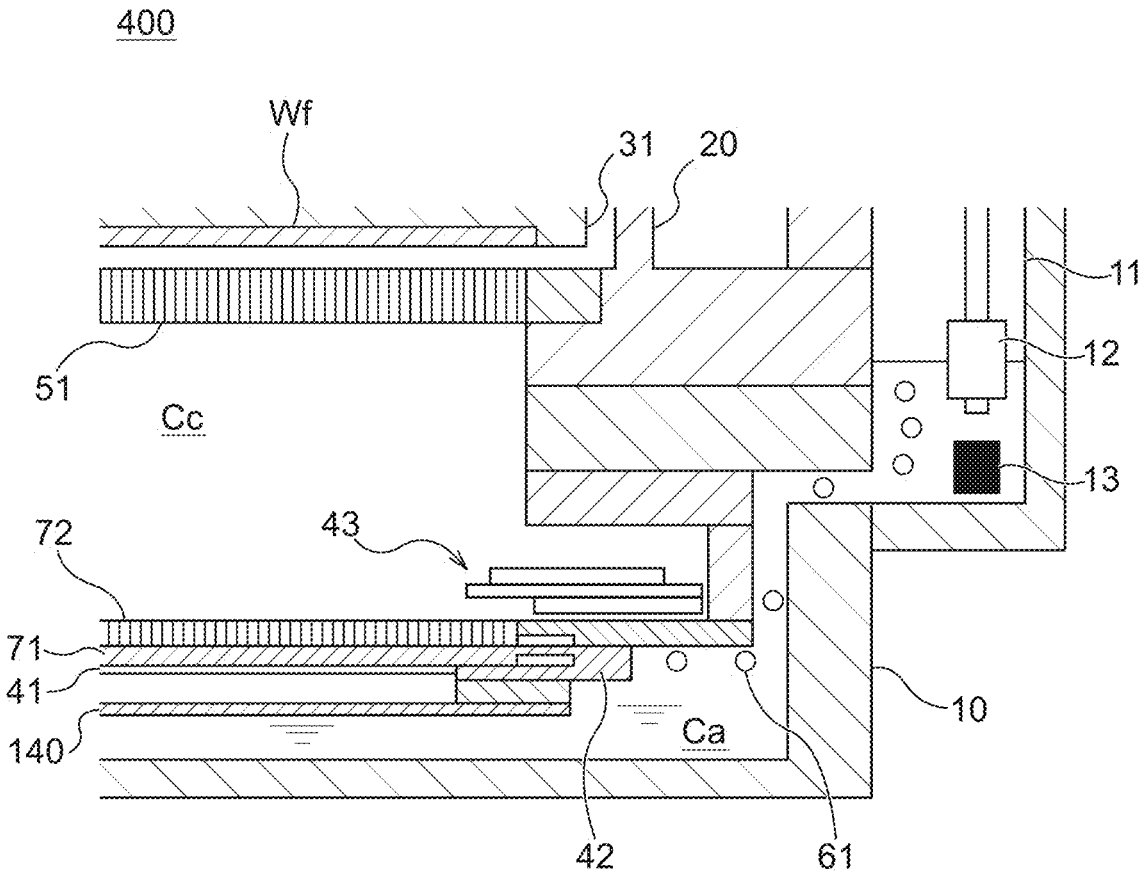
FIG. 4 is an enlarged sectional view illustrating part of the plating module.

FIG. 3 is a sectional view illustrating the configuration of the plating module according to one embodiment. FIG. 4 is an enlarged sectional view illustrating part of the plating module.

The plating apparatus 1000 according to the embodiment is a face down-type or a cup-type plating apparatus that causes a plating surface or a surface to be plated of a substrate to face down and to come into contact with a plating solution. The plating module 400 in the plating apparatus 1000 of the embodiment mainly includes a plating tank 10, an anode 41 placed in the plating tank 10, and a substrate holder 31 configured to hold a substrate Wf that serves as a cathode and that is arranged be opposed to the anode 41. The plating module 400 may be provided with a rotating mechanism, a tilting mechanism and/or a lift mechanism (not shown) configured to rotate, tilt and/or lift up and down the substrate holder 31. The plating tank 10 may be provided with an inner tank 10*a* that includes a cathode chamber Cc and an anode chamber Ca and with an outer tank 10*b* that serves as an overflow tank (overflow chamber) 20.

The plating tank 10 is configured by a bottomed vessel having an opening on an upper side thereof. The plating tank 10 (the inner tank 10*a*) has a bottom wall and a side wall extended upward from an outer periphery of this bottom wall and is open on an upper portion of this side wall. The plating tank 10 (the inner tank 10*a*) has an internal space in a cylindrical shape to store a plating solution Ps therein. The plating solution may be any solution including an ion of a metal element to form a plating film, and its concrete examples are not specifically limited. According to the embodiment, a copper plating process is employed as one example of a plating process, and a copper sulfate solution is used as one example of the plating solution. According to the embodiment, the plating solution includes a predetermined additive. The plating solution is, however, not limited to this composition but may be prepared not to include any additive. The plating tank 10 (the inner tank 10*a*) is parted into a cathode chamber Cc on an upper side and an anode chamber Ca on a lower side by a barrier membrane 71. According to the embodiment, the plating solution (anode solution) Ps in the anode chamber Ca and the plating solution (cathode solution) Ps in the cathode chamber Cc are supplied from an identical supply source and have an identical composition. There may, however, be some difference based on temporal changes of the plating solution Ps in the anode chamber Ca and the plating solution Ps in the cathode chamber Cc due to, for example, evaporation of water in the plating solution or the like. The plating tank 10 is also provided with an exhaust path 11 that communicates with the anode chamber Ca and that is open to the atmosphere. The exhaust path 11 discharges bubbles 61 included in the anode solution in the anode chamber Ca. According to the embodiment, at least part of the exhaust path 11 is extended in a vertical direction outside of the overflow tank 20 (the outer tank 10*b*) and is open at an exhaust path outlet to the atmosphere.

The overflow tank 20 is configured by a bottomed vessel placed outside of the inner tank 10*a* of the plating tank 10. The overflow tank 20 serves to temporarily accumulate the plating solution flowing over an overflow surface OFc (in this illustrated example, an upper end of the inner tank 10*a* of the plating tank 10). In one example, the plating solution in the overflow tank 20 is discharged from a discharge outlet for the overflow tank 20, flows through a flow path 95 to a reservoir tank 81, is temporarily accumulated in the reservoir tank 81, and is returned to the cathode chamber Cc in the plating tank 10.

The anode 41 is placed in a lower portion inside of the plating tank 10. The concrete type of the anode 41 is not specifically limited, but a soluble anode or an insoluble anode may be used. According to the embodiment, an insoluble anode is used as the anode 41. The concrete type of this insoluble anode is not specifically limited, but platinum, titanium, iridium oxide and the like (for example, IrO2/Ti or Pt/Ti) may be used. A top coat layer may be provided on a surface of the anode 41 with a view to, for example, suppressing degradation of the additive included in the plating solution.

According to the embodiment, an anode mask 43 is provided on an upper face side (substrate Wf-side) of the anode 41. The anode mask 43 has an opening which the anode 41 is exposed from and serves as an electric field regulating member configured to adjust an exposure range of the anode 41 by the opening and thereby regulate an electric field from the anode 41 toward the substrate Wf. The anode mask 43 may be an anode mask having predetermined opening dimensions or may be a variable anode mask having variable opening dimensions. For example, the anode mask 43 may have a plurality of blades to adjust the opening dimensions of the opening by a mechanism similar to an aperture or a diaphragm of a camera. In some cases, the anode mask 43 may be omitted.

A porous resistor 51 is placed above the barrier membrane 71 inside of the plating tank 10. More specifically, the resistor 51 is configured by a porous plate member having a plurality of pores (fine pores). The plating solution on a lower side of the resistor 51 is allowed to pass through the resistor 51 and flow to an upper side of the resistor 51. This resistor 51 is a member provided to homogenize an electric field formed between the anode 41 and the substrate Wf. Placing such a resistor 51 in the plating tank 10 facilitates uniformization of the film thickness of a plating film (plating layer) formed on the substrate Wf. The resistor 51 is, however, not an essential component according to the embodiment, but the embodiment may be configured without the resistor 51.

A paddle (not shown) may be placed in the vicinity of the substrate Wf (between the resistor 51 and the substrate Wf according to the embodiment) inside of the plating tank 10. The paddle moves back and forth in a direction approximately parallel to a surface to be plated or a plating surface of the substrate Wf to generate a strong flow of the plating solution on the surface of the substrate Wf. This homogenizes the ion in the plating solution in the vicinity of the surface of the substrate Wf and improves the in-plane uniformity of the plating film formed on the surface of the substrate Wf.

Configuration of Anode and Barrier Membrane

Figure 5:
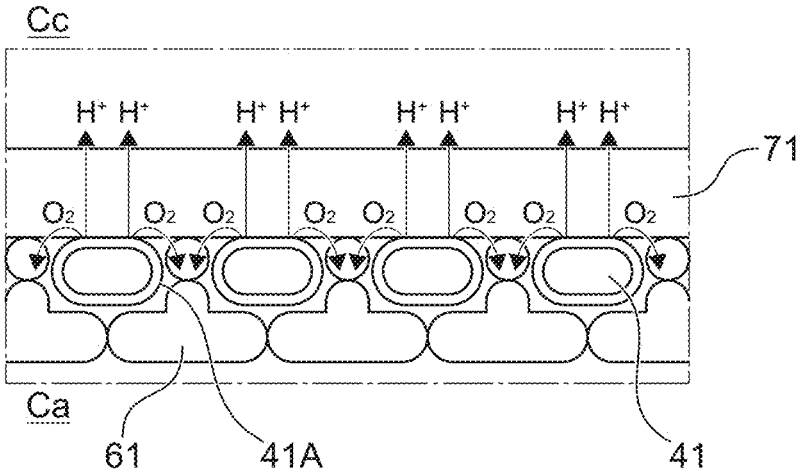
FIG. 5 is an enlarged sectional view illustrating the vicinity of an anode.
Figure 6:
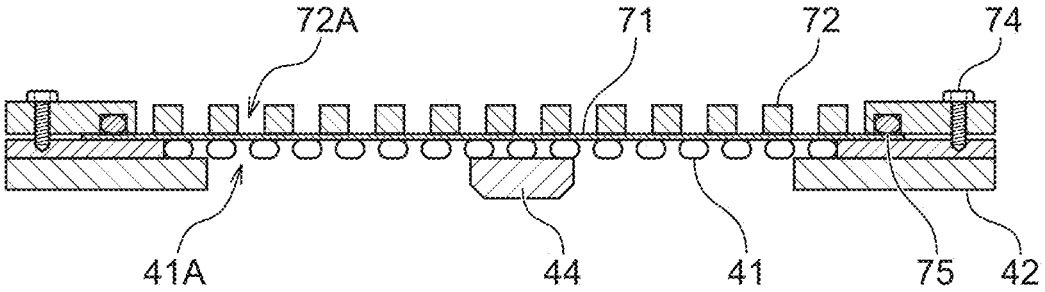
FIG. 6 is a sectional view illustrating an example of a fixation structure of a barrier membrane 71 to an anode 41.
Figure 7:
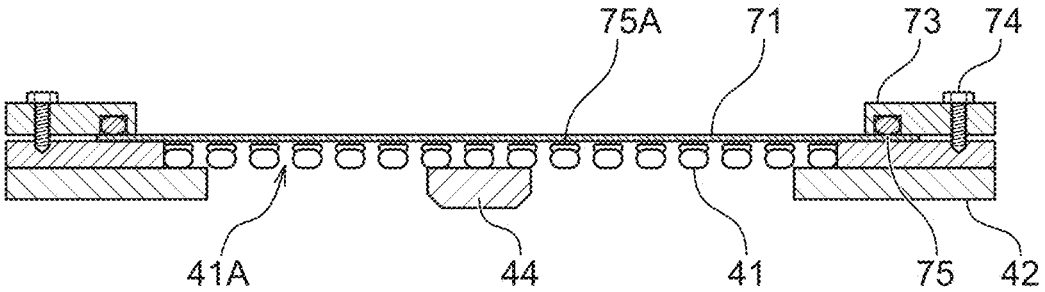
FIG. 7 is a sectional view illustrating another example of the fixation structure of the barrier membrane 71 to the anode 41.

According to the embodiment, as shown in FIG. 5 to FIG. 7, the anode 41 is a plate-like member having a large number of through holes 41A. The anode 41 may be a plate-like member having a lath (wire net) structure or another structure provided with a large number of through holes. The thickness of the anode 41 is not specifically limited but is preferably about 0.5 mm to 3 mm in terms of the intensity of the anode 41 itself and the easiness of discharge of oxygen that is generated on the surface of the anode 41, through the through holes to a rear face of the anode 41. The shape and the size of the through holes are not specifically limited, but the opening size (the diameter in the case of circular through holes or the length of one side in the case of rectangular through holes) is preferably about 1 mm to 5 mm in terms of the easiness of processing and the stability of a voltage in a plating process. The anode 41 is supported by an anode holder 42 that is also called an anode retainer in the plating tank 10.

As shown in FIG. 3 and FIG. 4, the barrier membrane 71 (for example, a Nafion (registered trademark) membrane or a porous membrane) having ion permeability to be impregnated with and moistened with the plating solution, is joined with or is brought into close contact with a front face of the anode 41 (a cathode/substrate-side face, an upper face in the illustrated example). According to the embodiment, the inside of the inner tank 10*a* of the plating tank 10 is parted into the anode chamber Ca and the cathode chamber Cc by this barrier membrane 71. The barrier membrane 71 is a membrane that allows a cation (for example, hydrogen ion H+) included in the plating solution to permeate through but does not allow bubbles of a gas (for example, oxygen gas) and the additive included in the plating solution to permeate through. In the case of using an insoluble anode, the hydrogen ion H+ is generated in the plating solution on the surface of the anode. The barrier membrane 71 may be, for example, a neutral membrane, an ion exchange membrane or a combination thereof. The barrier membrane 71 may be comprised of a plurality of membranes or layers laid one upon another. The configuration of the barrier membrane 71 is only one example, and the barrier membrane 71 may have another configuration.

FIG. 5 is an enlarged sectional view illustrating the vicinity of the anode 41. The anode 41 has a large number of through holes 41A, so that the surface of the anode 41 is kept constantly moistened with the plating solution that is supplied through the through holes 41A even during an electrode reaction. The barrier membrane 71 is the membrane having ion permeability to be impregnated with and moistened with the plating solution. As shown in this drawing, the plating solution reacts with the anode 41 on a substrate-side face thereof (a location which the barrier membrane 71 is brought into close contact with or its neighborhood), and the cation (for example, hydrogen ion H+) is transmitted through the barrier membrane 71 to the cathode chamber Cc, i.e., to a substrate side. Accordingly, an ion conductive path (current path) is formed from the substrate-side face (the location which the barrier membrane 71 is brought into close contact with or its neighborhood) of the anode 41 through inside of the barrier membrane 71 to the substrate Wf. As shown in this drawing, bubbles 61 of a gas (for example, oxygen O2) generated on the surface of the anode 41 are, on the other hand, not allowed to pass through the barrier membrane 71 but move through the large number of through holes 41A of the anode 41 to a rear face (a face opposite to the front face) side of the anode 41. The bubbles 61 moved to the rear face side of the anode 41 are discharged through the exhaust path 11 provided outside of the barrier membrane 71 (shown in FIG. 3 and FIG. 4) to outside of the plating tank 10.

This configuration that the barrier membrane 71 is brought into close contact with the substrate-side face of the anode 41 suppresses the bubbles 61 generated on the surface of the anode 41 from being diffused to the substrate Wf-side. This accordingly suppresses the bubbles 61 from being diffused to the substrate side and from being attached to the resistor 51, the substrate Wf and the like. Furthermore, the configuration that the barrier membrane 71 is brought into close contact with the anode 41 prevents accumulation of the bubbles 61 between the barrier membrane 71 and the anode 41. More specifically, this configuration avoids a problem that the bubbles 61 are accumulated on a rear face of the barrier membrane 71 as in the case where the barrier membrane 71 is separated from the anode 41. The rear face side of the anode 41 that forms a discharge pathway of the bubbles 61 is not a primary ion conductive path between the anode 41 and the substrate Wf. The bubbles 61, if present, on the rear face side of the anode 41 accordingly do not work as an ion conduction resistive component between the anode and the substrate and hardly affect the ion conduction (plating current) between the anode and the substrate. This configuration enables the cation (H+) to be conducted from the substrate-side face (the location which the barrier membrane 71 is brought into close contact with or its neighborhood) of the anode 41 through the barrier membrane 71 to the substrate Wf-side. Accordingly, this certainly provides an ion conductive path between the anode 41 and the substrate Wf, while avoiding the effects of the bubbles 61.

As described above, this configuration provides the stable ion conductive path between the anode and the cathode and prevents the bubbles 61 from being accumulated on the ion conductive path between the anode and the cathode and adversely affecting the ion conduction. As a result, this reduces the effects of the bubbles generated on the anode and allows for stable plating on the substrate, thus enhancing the uniformity in the thickness of the plating film.

FIG. 6 and FIG. 7 are sectional views illustrating fixation structures of the barrier membrane 71 to the anode 41. These drawings show that a boss for power feeding 44 is provided in a center area on the rear face of the anode 41 to feed electricity to the anode 41. The boss for power feeding 44 may be formed integrally with the anode 41 or may be attached to the anode 41. FIG. 3 and FIG. 4 correspond to an example that employs a retainer plate 72 (shown in FIG. 6).

In the illustrated example of FIG. 6, the barrier membrane 71 is pressed against the substrate side-face of the anode 41 by the retainer plate 72 having a large number of through holes 72A to be fixed in such a state that the barrier membrane 71 is brought into close contact with the upper face of the anode 41. The retainer plate 72 is fixed to the anode holder 42 by means of fastening members 74, for example, screws, such as to press down the anode 41 and the barrier membrane 71. This configuration places the barrier membrane 71 between the retainer plate 72 and the anode 41 and causes the barrier membrane 71 to be brought into close contact with the anode 41. Furthermore, a seal member 75 (for example, an O-ring) is provided between the retainer plate 72 and the barrier membrane 71 to seal between the retainer plate 72 and the barrier membrane 71. It is preferable that the anode holder 42 and the retainer plate 72 are made of a material that is not corroded by the plating solution, for example, a resin such as vinyl chloride or a metal such as Pt or Ti.

In the illustrated example of FIG. 7, the barrier membrane 71 is joined with and fixed to the substrate side-face of the anode 41. A joint layer/adhesive layer 75A serving to join the barrier membrane 71 with the anode 41 preferably has ion permeability. The joint layer 75A is, for example, a resin joint layer having an ion exchange group or a porous joint layer including a resin and a filler and may be made of a perfluorocarbon material having a sulfonic acid group as an example. An outer peripheral portion of the barrier membrane 71 is pressed against and fixed to the anode holder 42 by a retainer ring 73. Furthermore, a seal member 75 (for example, an O-ring) is provided between the retainer ring 73 and the barrier membrane 71 to seal between the retainer ring 73 and the barrier membrane 71. It is preferable that the anode holder 42 and the retainer ring 73 are made of a material that is not corroded by the plating solution, for example, a resin such as vinyl chloride or a metal such as Pt or Ti.

As shown in FIG. 3 and FIG. 4, a bubble regulating plate (rear face plate) 140 is provided below the anode 41 in the anode chamber Ca, such as to be opposed to a lower face of the anode 41. A gap is formed between the bubble regulating plate 140 and the anode 41 by means of a spacer or the like. A space between the bubble regulating plate 140 and the anode 41 is configured to communicate with an outer space in the anode chamber at one or a plurality of locations. The bubble regulating plate 140 limits the thickness of bubbles accumulated on the lower face of the anode 41 (shown in FIG. 5) to be within a distance between the anode 41 and the bubble regulating plate 140. This reduces an accumulation amount of bubbles on the lower face of the anode 41 and suppresses a change in accumulation amount of bubbles accompanied with release of bubbles on the lower face of the anode 41 in the course of plating. This accordingly suppresses a pressure change of the plating solution in the vicinity of the lower face of the anode 41 and suppresses a variation in electrode potential at the anode 41. This configuration thus suppresses a variation in electrode potential of the anode in the course of plating and suppresses reduction of the uniformity in the thickness of the plating film.

Instead of the bubble regulating plate 140, a bubble buffer ring (not shown) may be placed to surround the periphery of the anode 41 and to be protruded downward by a predetermined height from the lower face of the anode. This modified configuration causes bubbles to be continuously accumulated on the lower face of the anode up to the height of an end face of the bubble buffer ring and causes bubbles to be constantly present over the entire lower face of the anode. This suppresses a change in accumulation amount of bubbles accompanied with discharge of bubbles on the lower face of the anode in the course of plating. Another modification may be provided with neither the bubble regulating plate 140 nor the bubble buffer ring.

Configuration of Anode Chamber Liquid Level Management

The plating solution (anode solution) in the anode chamber Ca enters the exhaust path 11 that communicates with the anode chamber Ca, as shown in FIG. 3 and FIG. 4. A liquid surface or level Sa of the plating solution in the exhaust path 11 is a liquid surface or level of the plating solution in the anode chamber Ca. The bubbles 61 moving to a rear face side of the anode 41 are discharged through the exhaust path 11 to outside of the plating tank 10. This configuration enables the bubbles 61 generated at the anode 41 to be naturally discharged via the exhaust path 11 and does not need to circulate the plating solution in the anode chamber Ca and thereby discharge the bubbles.

The exhaust path 11 is provided with an overflow path 11A that communicates with the overflow tank 20. A lower face of this overflow path 11A defines an overflow surface OFa of the anode chamber Ca. The overflow path 11A is provided such that the height of the overflow path 11A (the overflow surface OFa) is lower than an overflow surface OFc in the cathode chamber Cc.

The liquid level Sa of the plating solution in the exhaust path 11 (in the anode chamber Ca) is set to be below the overflow path 11A (the overflow surface OFa) or, in other words, is set such that the plating solution in the exhaust path 11 (in the anode chamber Ca) does not overflow to the overflow tank 20. More specifically, the liquid level Sa of the plating solution in the exhaust path 11 (in the anode chamber Ca) is set such that the plating solution in the exhaust path 11 (in the anode chamber Ca) does not overflow to the cathode chamber Cc-side, i.e., to the overflow tank 20, even when the volume of the bubbles generated in the anode chamber Ca increases to raise the liquid level Sa. This configuration prevents the plating solution in the anode chamber Ca where the additive is consumed from being mixed into the cathode chamber Cc via the overflow tank 20 and deteriorating the plating solution in the cathode chamber Cc.

In the event of an emergency that the plating solution in the cathode chamber Cc leaks to the anode chamber Ca to raise the liquid level of the plating solution in the exhaust path 11 due to, for example, breakage of the barrier membrane 71, the plating solution in the exhaust path 11 overflows through the overflow path 11A to the overflow tank 20. Even in this case, since the overflow surface OFa of the plating solution in the anode chamber Ca is set to be lower than the overflow surface OFc of the plating solution in the cathode chamber Cc, the pressure in the cathode chamber Cc is kept higher than the pressure in the anode chamber Ca. The barrier membrane 71 is pressed against and brought into close contact with the anode 41 by this pressure difference.

A liquid level sensor 12 is placed in the plating solution inside of the exhaust path 11. The liquid level sensor 12 is configured to detect whether the liquid level Sa of the plating solution in the exhaust path 11 is equal to or higher than a predetermined height (or is lower than a predetermined height). An electrode-type, a float-type (for example, a float switch), a capacitive-type, an ultrasonic-type, a vibration-type or any other type of liquid level sensor may be employed for the liquid level sensor 12. For example, the liquid level sensor 12 may output an ON signal when the liquid level Sa of the plating solution is equal to or higher than the predetermined height and output an OFF signal when the liquid level Sa of the plating solution is lower than the predetermined height. In another example, the liquid level sensor 12 may be configured to measure a distance to the liquid level. The liquid level sensor 12 is connected with the control module 800 by wire or wirelessly, and the control module 800 receives output of the liquid level sensor 12.

A concentration sensor (electric conductivity sensor) 13 is also placed in the plating solution inside of the exhaust path 11. In the description hereof, the electric conductivity and the electric conductivity sensor may also be called the conductivity and the conductivity sensor. The concentration sensor (electric conductivity sensor) 13 may be placed in the anode chamber Ca. The concentration sensor (electric conductivity sensor) 13 is connected with the control module 800 by wire or wirelessly. The concentration sensor (electric conductivity sensor) 13 means that either one of the concentration sensor and the electric conductivity sensor is provided. Both the concentration sensor and the electric conductivity sensor may, however, be provided or both the concentration sensor and the electric conductivity sensor may be omitted.

As shown in FIG. 3, the cathode chamber Cc and the anode chamber Ca receive a supply of the plating solution from the reservoir 81. The cathode chamber Cc is connected with the reservoir 81 via flow paths 83 and 82. The anode chamber Ca is connected with the reservoir 81 via flow paths 85, 84 and 82. A pump 86 and a filter 87 are placed in the flow path 82. A valve 88 is placed in the flow path 83, and a valve 89 is placed in the flow path 84. When the valve 88 is opened, the plating solution is supplied from the reservoir 81 to the cathode chamber Cc. When the valve 89 is opened, the plating solution is supplied from the reservoir 81 to the anode chamber Ca. The plating solution that flows over the overflow surface OFc of the cathode chamber Cc is collected by the overflow tank 20 and is returned to the reservoir 81 via the flow path 95. The reservoir 81, the flow paths 82 and 83, the overflow tank 20 and the flow path 95 configure a circulation path 80 of the cathode chamber Cc. The plating solution in the cathode chamber Cc is circulated through the circulation path 80 in the course of plating.

After the plating solution is supplied from the reservoir 81 to the anode chamber Ca to be charged to a predetermined height in the exhaust path 11, the valve 89 is closed, and the plating solution in the anode chamber Ca is not circulated. The plating module 400 shown in FIG. 3 is configured such that the same plating solution as the plating solution supplied to the cathode chamber is supplied to the anode chamber and that the plating solution overflowing from the cathode chamber and the anode chamber enters the common overflow tank 20, is returned to the common reservoir 81 and is then resupplied to the cathode chamber and the anode chamber. Circulation of the plating solution on the anode side in the course of plating causes the expensive additive to be continuously degraded (consumed) in the anode chamber Ca. Accordingly, the plating solution is supplied to the anode chamber Ca, only for the purpose of filling the anode chamber Ca, and the plating solution in the anode chamber Ca is not circulated.

A liquid supply source 91 is connected with the anode chamber Ca via flow paths 85 and 92, and a valve 93 is placed in the flow path 92. In this example, the liquid supply source 91 is a supply source of supplying pure water (for example, DIW). When the valve 93 is opened, pure water is supplied from the liquid supply source 91 to the anode chamber Ca. The flow paths 85 and 92 and the liquid supply source 91 configure a liquid supply path 90. According to the embodiment, when the liquid level sensor 12 detects that the liquid level Sa of the plating solution in the anode chamber Ca becomes lower than a predetermined height H0, the valve 93 is opened to supply pure water from the liquid supply source 91 through the flow paths 92 and 85 to the anode chamber Ca. When the concentration sensor (electric conductivity sensor) 13 detects that the concentration (electric conductivity) of the plating solution in the anode chamber Ca becomes higher than a predetermined concentration (electric conductivity), the control module 800 gives an alarm. When the liquid level Sa of the plating solution is lowered by evaporation of water included in the plating solution in the anode chamber Ca, the concentration (electric conductivity) of the plating solution is increased according to the evaporated water. Accordingly, increasing the concentration (electric conductivity) of the plating solution to be higher than the predetermined concentration (electric conductivity) is equivalent to lowering the liquid level Sa of the plating solution to be lower than a specific height. In one example, the predetermined concentration (electric conductivity) is set to a value corresponding to the predetermined height H0 of the liquid level Sa of the plating solution.

Flowchart of Anode Chamber Liquid Management Control

Figure 8:
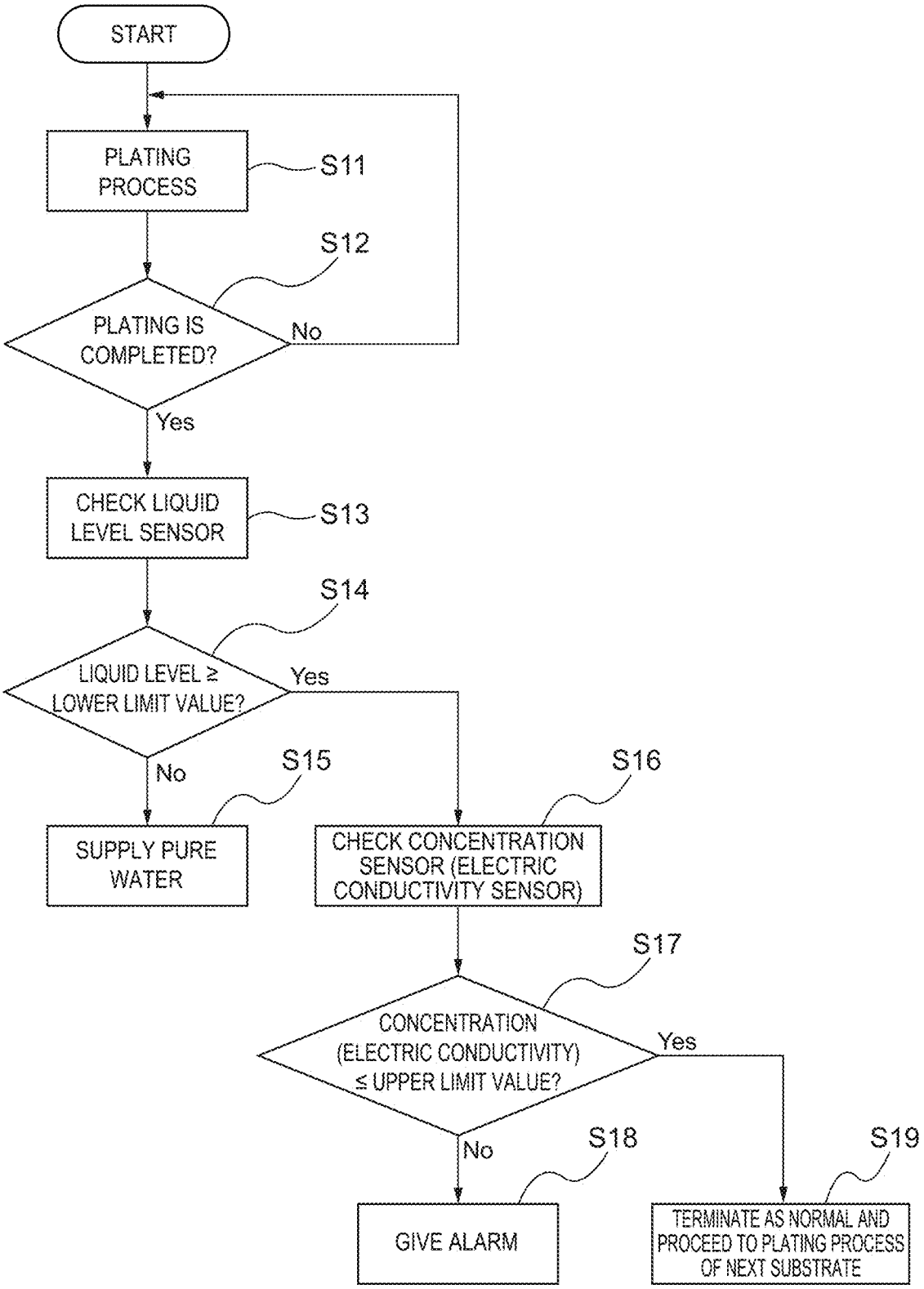
FIG. 8 is a flowchart showing anode chamber liquid management control.

FIG. 8 is a flowchart showing anode chamber liquid management control. This process is performed by the control module 800.

At step S11, a plating process of the substrate Wf is performed. At step S12, it is determined whether the plating process is completed. When the plating process is not yet completed, the processing flow returns to step S11 to continue the plating process. When it is determined at step S11 that the plating process is completed, the processing flow proceeds to step S13.

At step S13, the processing flow checks the output of the liquid level sensor 12. At step S14, it is determined whether the liquid level Sa of the plating solution in the anode chamber Ca is equal to or higher than a lower limit value (a predetermined height) H0, based on the output of the liquid level sensor.

When the output of the liquid level sensor 12 indicates that the liquid level Sa of the plating solution in the anode chamber Ca is lower than the lower limit value H0 (for example, OFF output of the sensor) at step S14, the processing flow proceeds to step S15.

At step S15, the valve 93 is opened to supply pure water from the liquid supply source 91 to the anode chamber Ca. The supply of pure water is continued, for example, until the liquid level Sa of the plating solution in the anode chamber Ca becomes equal to or higher than the lower limit value H0 (ON output of the liquid level senor), based on the output of the liquid level sensor 12. In the case where a height difference is conceivable between the liquid level Sa of the plating solution supplied to the anode chamber Ca in the initial stage and the liquid level Sa of the plating solution at the time of the OFF output of the liquid level sensor 12, pure water may be supplied like supply of the plating solution by an amount corresponding to the height difference.

When the output of the liquid level sensor 12 indicates that the liquid level Sa of the plating solution in the anode chamber Ca is equal to or higher than the lower limit value H0 (for example, ON output of the liquid level sensor) at step S14, the processing flow proceeds to step S16.

At step S16, the processing flow checks the output of the concentration sensor (electric conductivity sensor). At step S17, it is determined whether the concentration (electric conductivity) of the plating solution in the anode chamber Ca is equal to or lower than an upper limit value of the concentration (electric conductivity), based on the output of the concentration sensor (electric conductivity sensor).

When the output of the concentration sensor (electric conductivity sensor) 13 indicates that the concentration (electric conductivity) of the plating solution in the anode chamber is higher than a concentration upper limit value (electric conductivity upper limit value) at step S17, the processing flow proceeds to step S18 to give an alarm. In the case where the concentration (electric conductivity) is out of the normal range at step S17, there is a possibility that the liquid level sensor 12 malfunctions to give a false determination at step S14 that the liquid level Sa is equal to or higher than the lower limit value H0, despite the liquid level Sa that is actually lower than the lower limit value H0. An alarm is accordingly given at step S18. The user checks whether the liquid level sensor 12 malfunctions, in response to the alarm.

In the configuration provided with both the concentration sensor and the electric conductivity sensor, an alarm may be given when the output of either the concentration sensor or the electric conductivity sensor becomes higher than the upper limit value or when the outputs of both the concentration sensor and the electric conductivity sensor become higher than the upper limit values. In the configuration provided with one of the concentration sensor and the electric conductivity sensor, an alarm is given when the output of the sensor provided becomes higher than the upper limit value.

When the output of the concentration sensor (electric conductivity sensor) 13 indicates that the concentration (electric conductivity) of the plating solution in the anode chamber is equal to or lower than the concentration upper limit value (electric conductivity upper limit value) at step S17, the flow of anode chamber liquid management control is terminated at step S19 and proceeds to the plating process of a next substrate (step S11). In the configuration provided with both the concentration sensor and the electric conductivity sensor, it may be determined normal when the outputs of both the concentration sensor and the electric conductivity sensor are equal to or lower than the upper limit values or when the output of either the concentration sensor or the electric conductivity sensor is equal to or lower than the upper limit value. In the configuration provided with one of the concentration sensor and the electric conductivity sensor, it is determined normal when the output of the sensor provided is equal to or lower than the upper limit value. The term "normal" herein corresponds to the liquid level of the plating solution that is equal to or higher than the lower limit value H0.

Experimental Examples of Plating Module

Figure 9:
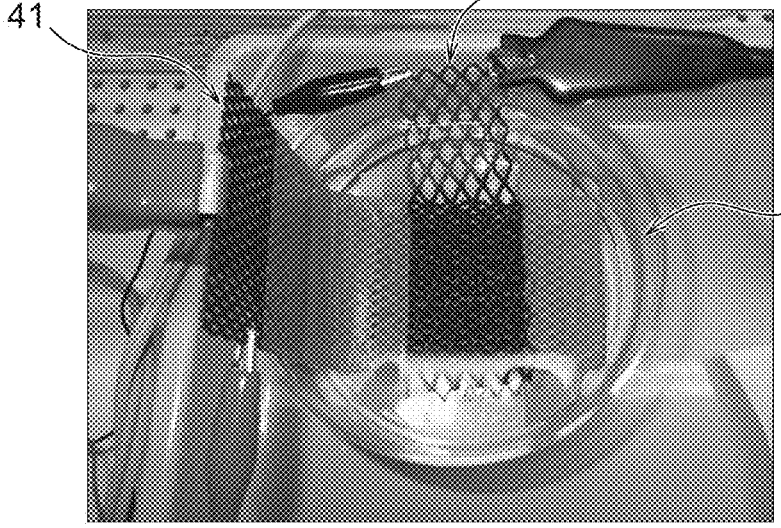
FIG. 9 is a photograph showing a plating module for experiment (without a barrier membrane)
Figure 10:
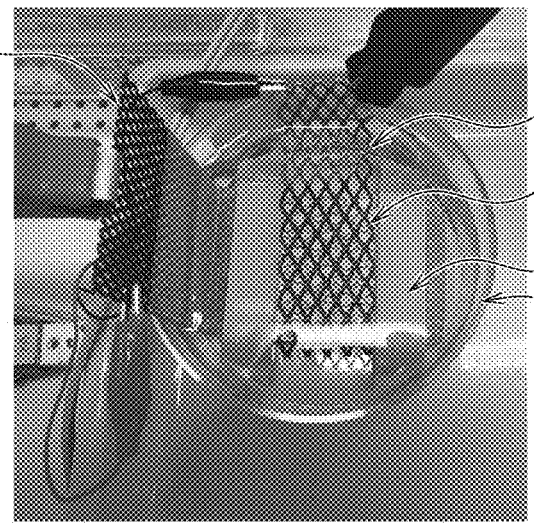
FIG. 10 is a photograph showing a plating module for experiment (with a barrier membrane)

The following describes experimental examples employing the configuration of the above embodiment to observe bubbles generated in the plating solution. FIG. 9 is a photograph showing a plating module for experiment (without a barrier membrane). FIG. 10 is a photograph showing a plating module for experiment (with a barrier membrane). In FIG. 9, an anode 41 and a cathode 32 (corresponding to a substrate Wf), which is arranged above the anode 41 to be separated from the anode 41 by a predetermined distance, are placed in a plating tank 10 that stores a plating solution therein (also referred to FIG. 12A and FIG. 12B). In FIG. 10, an anode 41, a barrier membrane 71 brought into close contact with an upper face of the anode 41, a retainer plate 72 arranged to hold the barrier membrane 71, and a cathode 32 arranged above the retainer plate 72 to be separated from the retainer plate 72 by a predetermined distance are placed in a plating tank 10 that stores a plating solution therein (also referred to FIG. 13A and FIG. 13B). In the respective drawings, the anode 41 is connected with a positive electrode terminal of a power source (not shown), and the cathode 32 is connected with a negative electrode terminal of the power source. The cathode 32 is separated from the retainer plate 72 by the buoyance of the plating solution. The cathode 32 may, however, be placed on a spacer or the like to be separated from the retainer plate 72.

Figure 11:
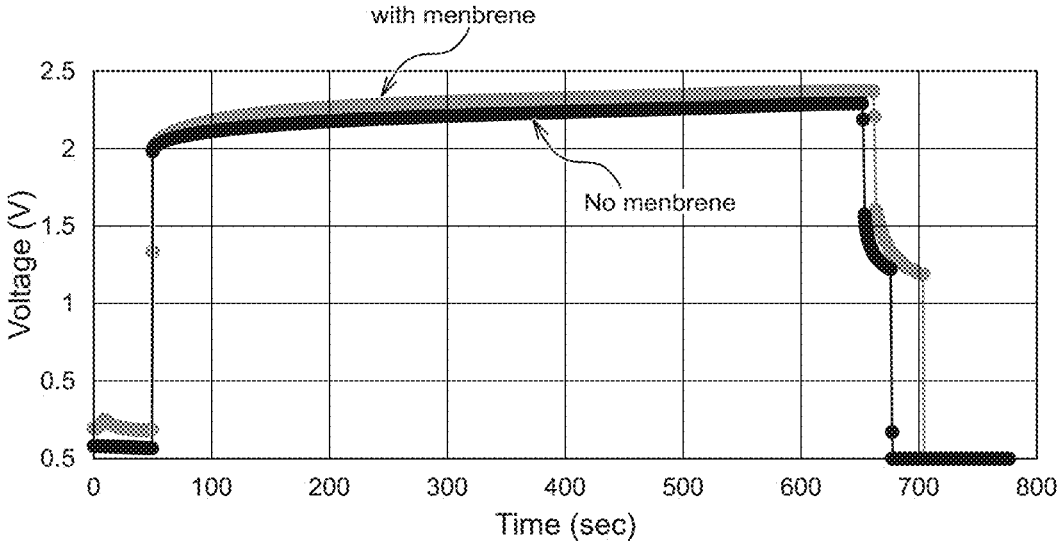
FIG. 11 is a graph showing results of measurement of an anode voltage in the process of plating.

Respective parameters used for the experiment are given below. In the experiment, an electrolytic solution free of metal ions was used in place of the plating solution, with a view to facilitating observation of generation of bubbles at the anode. An electrode reaction at the anode in the experiment was identical with the electrode reaction at the anode in the case of using the plating solution. The following shows the anode, the cathode, the electrolytic solution (plating solution), the anode area serving as the anode opposed to the cathode and the current density:

Anode: lath (wire net) of IrO2/Ti
Cathode: lath (wire net) of Pt/Ti
Barrier membrane: Yumicron Y09207TA (micro-porous membrane) (manufactured by Yuasa Membrane Systems Co., Ltd.)
Electrolytic solution: 100 g/L of H2SO4
Anode area: 0.24 dm2 (60 mm□40 mm)
Current density: 5ASD FIG. 11 shows results of measurement of an anode voltage in the course of plating. These results of the experiment show that the voltage at the anode 41 during electric conduction is stable even in the case of using the barrier membrane 71 and that a variation in voltage in the case of using the barrier membrane 71 is similar to a variation in voltage in the case of using no barrier membrane. From these results, it is expected that the voltage between the anode and the cathode has a normal variation to perform a normal plating process even in the presence of the barrier membrane 71 brought into close contact with to the anode 41.

Figure 12A:
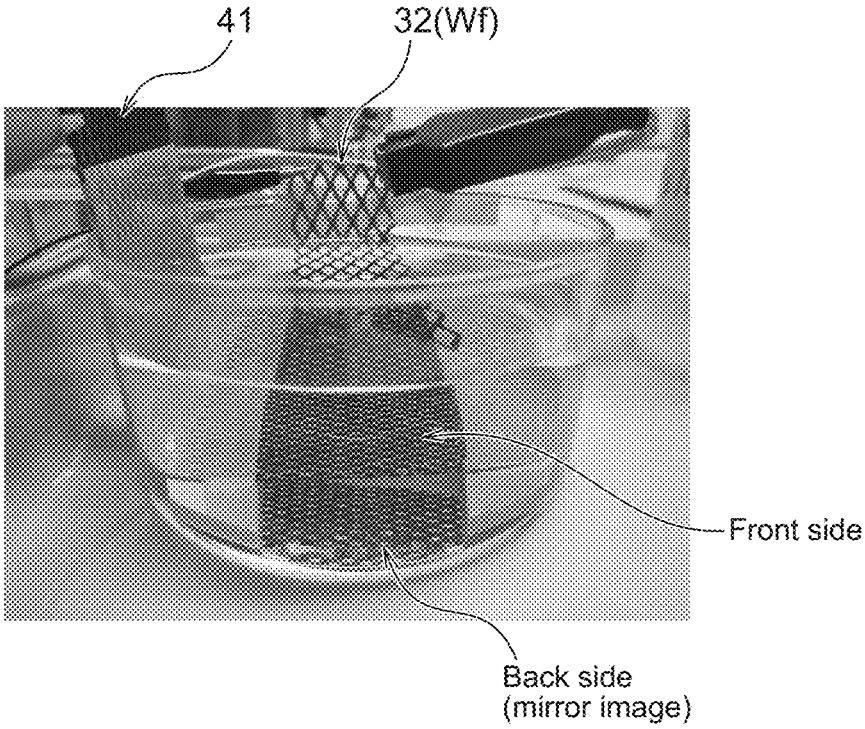
FIG. 12A is a photograph showing a plating module (without a barrier membrane) prior to plating.
Figure 12B:
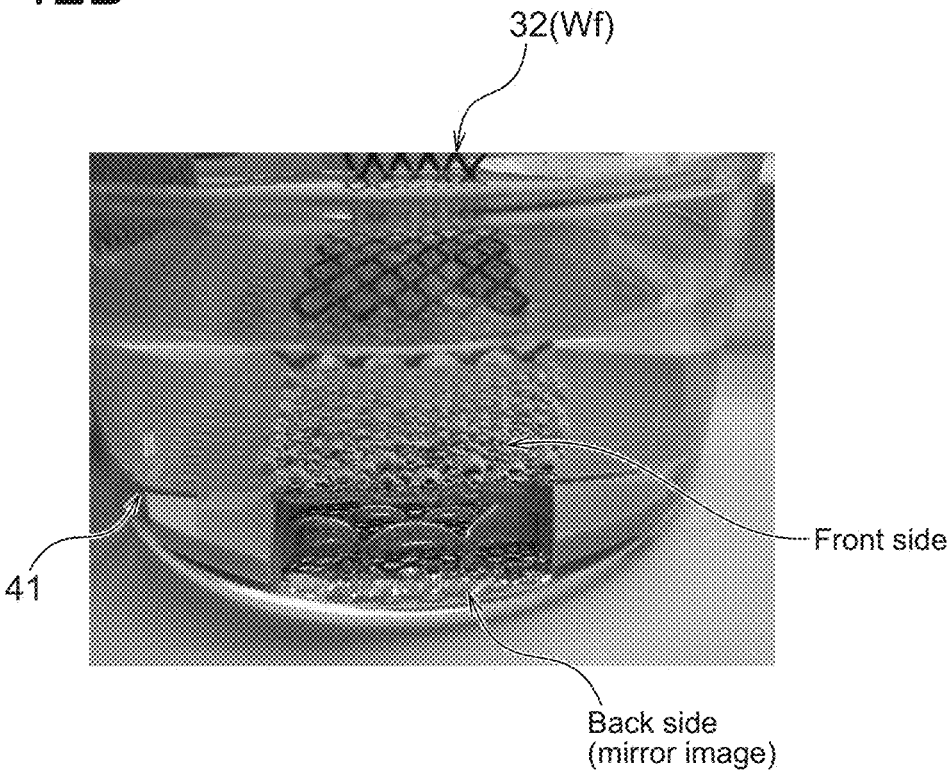
FIG. 12B is a photograph showing the plating module (without the barrier membrane) in the course of plating.

FIG. 12A is a photograph showing a plating module (without a barrier membrane) prior to plating. FIG. 12B is a photograph showing the plating module (without the barrier membrane) in the course of plating. As observed in these photographs, the plating module (without the barrier membrane) causes a large volume of bubbles generated at the anode 41 to be accumulated both above and below the anode 41. This configuration is expected to have adverse effects on the uniformity in the thickness of the plating film, due to accumulation of a large volume of bubbles between the anode 41 and the cathode 32 serving as the ion conductive path.

Figure 13A:
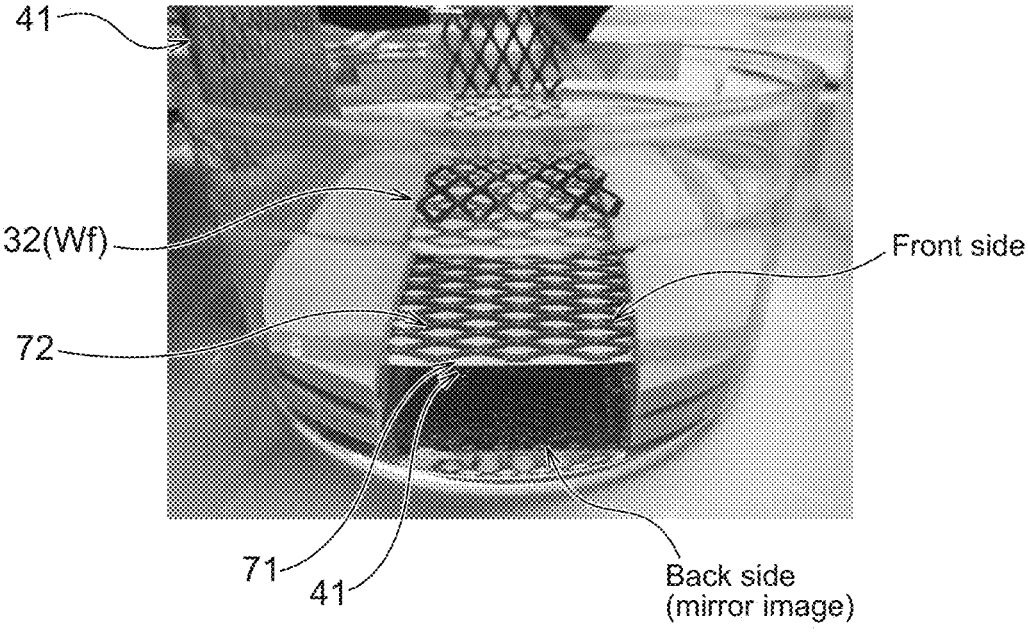
FIG. 13A is a photograph showing a plating module (with a barrier membrane) prior to plating.
Figure 13B:
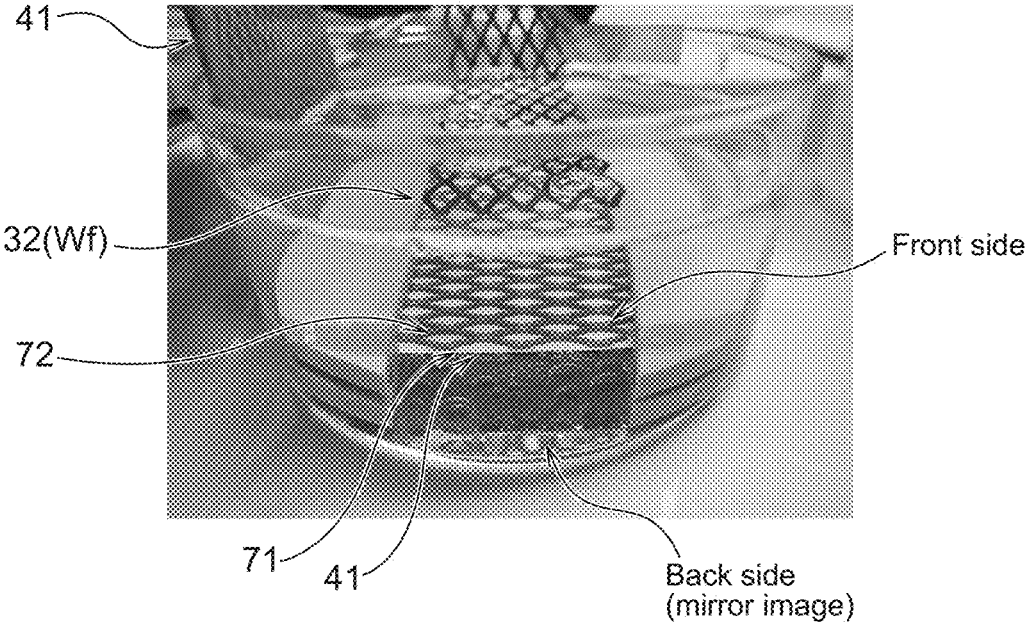
FIG. 13B is a photograph showing the plating module (with the barrier membrane) in the course of plating.

FIG. 13A is a photograph showing a plating module (with a barrier membrane) prior to plating. FIG. 13B is a photograph showing the plating module (with the barrier membrane) in the course of plating. As observed in these photographs, the plating module with the barrier membrane causes bubbles generated at the anode 41 to be present below the anode 41 but suppresses accumulation of bubbles between the anode 41 and the cathode 32 serving as the ion conductive path. Accordingly, this configuration is expected to enhance the uniformity in the thickness of the plating film.

The configuration of the embodiment described above has one or a plurality of the following functions and advantageous effects.

(1) The configuration of the above embodiment causes the liquid level in the anode chamber to be constantly kept lower than the liquid level in the cathode chamber. The barrier membrane is thus pressed against and brought into close contact with the anode by the pressure in the cathode chamber that is higher than the pressure in the anode chamber.

(2) The configuration of the above embodiment uses the liquid level sensor to monitor the liquid level in the anode chamber and supplies pure water to the anode chamber when the liquid level in the anode chamber becomes lower than the predetermined height (lower limit value). This configuration accordingly suppresses or prevents depletion of the plating solution in the anode chamber.

(3) The configuration of the above embodiment does not circulate the plating solution in the anode chamber but enables the gas generated at the anode to be naturally discharged. This simplifies the structure and/or the operation of the plating tank.

(4) The configuration of the above embodiment suppresses the bubbles (resistive component) from being accumulated on the ion conductive path between the anode and the substrate and from affecting the uniformity in the thickness of the plating film. This configuration also enables the cation to be conducted through the barrier membrane that is brought into close contact with the anode, to the substrate side. This certainly provides the ion conductive path between the anode and the substrate, while avoiding the effects of the bubbles. This accordingly ensures stable plating on the substrate, while suppressing an ion conductive resistance from being generated on the ion conductive path between the anode and the substrate by the bubbles from the anode, thus enhancing the uniformity in the thickness of the plating film.

(5) The configuration of the above embodiment allows an insoluble anode to be used for the anode. This improves the easiness of maintenance of the anode and reduces the running cost.

(6) In the configuration of the above embodiment, using the bubble regulating plate or the bubble buffer ring suppresses an abrupt pressure change in the vicinity of the surface of the anode (the inner wall of the through holes and the rear face), which is caused by release of the bubbles accumulated on the rear face of the anode. This suppresses a variation in the saturated dissolved oxygen concentration in the vicinity of the surface of the anode (the inner wall of the through holes and the rear face) and a resulting variation in the electrode voltage of the anode, thus suppressing reduction of the in-plane uniformity in the thickness of the plating film.

Modifications (1) The configuration of the above embodiment supplies pure water to the anode chamber, based on the output of the liquid level sensor, after the plating process. A modified configuration may supply pure water based on the output of the liquid level sensor, in at least one of the timings: prior to the plating process, in the course of plating process and after the plating process.

(2) The above embodiment is described with reference to the configuration of using the concentration sensor and/or the electric conductivity sensor in addition to the liquid level sensor. A modified configuration may omit the concentration sensor and the electric conductivity sensor.

(3) The configuration of the above embodiment supplies pure water to the anode chamber, based on the output of the liquid level sensor. A modified configuration may supply an electrolytic solution. The electrolytic solution used may be an electrolytic solution having a lower concentration than the concentration of the plating solution in the anode chamber and/or in the cathode chamber. In order to suppress a change in concentration of the plating solution in the anode chamber, the electrolytic solution used is preferably an electrolytic solution having a lower concentration than the concentration of the plating solution in the anode chamber and/or in the cathode chamber.

In the configuration of supplying the electrolytic solution, the concentration/the electric conductivity of the plating solution in the anode chamber increases every time the electrolytic solution is supplied. The upper limit value for evaluation of the detection value of the concentration sensor/the electric conductivity sensor is accordingly set by taking into account the concentration of the electrolytic solution. Another modification may omit the concentration sensor/the electric conductivity sensor and the control based on these sensors (S16 to S18 in FIG. 8).

(4) The configuration of the above embodiment does not circulate the plating solution (anode solution) in the anode chamber. A modified configuration may be provided with a circulation path for the anode solution separately from the circulation path for the cathode solution. This modified configuration enables the bubbles in the plating solution in the anode chamber to be more actively discharged to outside.

(5) The configuration of the above embodiments uses the electrolytic solution of the identical composition for the anode solution and for the cathode solution. A modified configuration may use electrolytic solutions of different components for the anode solution and for the cathode solution. For example, the presence or the absence of an additive and the concentration of the additive may differ between the anode solution and the cathode solution. For example, an elemental composition solution (VMS: Virgin Makeup Solution) that is a plating solution free of additives may be used as the anode solution. In this modified configuration, separate plating solution supply paths are provided for the cathode chamber and for the anode chamber.

(6) The configuration of the above embodiment is provided with the common overflow tank for the cathode solution and the anode solution. One modified configuration may be provided separately with an overflow tank for the cathode solution and an overflow tank for the anode solution. This modified configuration prevents the plating solution including the expensive additive from being supplied to the anode chamber and thereby prevents consumption of the additive.

At least the following aspects are provided from the description of the above embodiment.

[1] According to one aspect, there is provided a method of liquid management in an anode chamber. The method comprises providing a plating tank that comprises an anode; a barrier membrane placed to come into contact with or to be brought into close contact with an upper face of the anode; a cathode chamber on an upper side and an anode chamber on a lower side parted by the barrier membrane; and an exhaust path provided to communicate with the anode chamber and configured to discharge bubbles from the anode chamber to outside of the plating tank; storing a plating solution in the anode chamber and in the cathode chamber, such that a liquid level of the plating solution in the exhaust path that is a liquid level of the plating solution in the anode chamber is lower than a liquid level of the plating solution in the cathode chamber; determining whether the liquid level of the plating solution in the exhaust path is lower than a predetermined height, based on an output of a liquid level sensor placed in the exhaust path; and supplying pure water or an electrolytic solution to the anode chamber, when it is determined that the liquid level of the plating solution in the exhaust path is lower than the predetermined height.

The electrolytic solution may be an electrolytic solution having an identical composition with a composition of the plating solution in the anode chamber and/or in the cathode chamber or an electrolytic solution having a lower concentration than a concentration of the plating solution in the anode chamber and/or in the cathode chamber. With a view to suppressing a change in concentration of the plating solution in the anode chamber, the electrolytic solution is preferably an electrolytic solution having a lower concentration than a concentration of the plating solution in the anode chamber and/or in the cathode chamber.

The configuration of this aspect controls the liquid level in the anode chamber to be lower than the liquid level in the cathode chamber. This enables the barrier membrane to be pressed against and brought into close contact with the anode by the pressure in the cathode chamber that is higher than the pressure in the anode chamber. The configuration of this aspect also supplies the pure water or the electrolytic solution to the anode chamber, such as to prevent the liquid level in the anode chamber (exhaust path) from becoming lower than the predetermined height. This suppresses or prevents depletion of the plating solution in the anode chamber.

[2] According to one aspect, in the method of the above aspect, the storing the plating solution may comprise storing the plating solution in the anode chamber, such that the liquid level of the plating solution in the anode chamber is lower than an overflow height of the plating solution that overflows from the anode chamber.

The configuration of this aspect suppresses or prevents the plating solution in the anode chamber where the additive is consumed from flowing into the overflow tank and being circulated to the cathode chamber. This configuration accordingly suppresses or prevents a decrease in the concentration of the additive in the plating solution or deterioration of the plating solution in the cathode chamber.

[3] According to one aspect, in the method of the above aspect, the supplying the pure water or the electrolytic solution may comprise supplying the pure water or the electrolytic solution to the anode chamber, such that the liquid level of the plating solution in the anode chamber is lower than an overflow height of the plating solution that overflows from the anode chamber.

The configuration of this aspect suppresses or prevents the plating solution in the anode chamber where the additive is consumed from flowing into the overflow tank and being circulated to the cathode chamber. This configuration accordingly suppresses or prevents deterioration of the plating solution in the cathode chamber.

[4] According to one aspect, the method of the above aspect may further comprise when the liquid level of the plating solution in the anode chamber is raised, causing the plating solution in the anode chamber to overflow at a height lower than an overflow height of the plating solution in the cathode chamber.

Even in the case of a rise of the liquid level in the anode chamber due to some reason (even in the event of an emergency), the configuration of this aspect enables the liquid level in the anode chamber to be kept lower than the liquid level in the cathode chamber and enables the barrier membrane to be kept close contact with the anode. For example, even when the plating solution in the cathode chamber flows into the anode chamber due to deterioration of the barrier membrane or the like to raise the liquid level in the anode chamber, this configuration limits the liquid level in the anode chamber to a range that is lower than the liquid level in the cathode chamber.

[5] According to one aspect, the method of the above aspect may further comprise circulating the plating solution in the cathode chamber without circulating the plating solution in the anode chamber.

The configuration of this aspect does not circulate the plating solution in the anode chamber and accordingly reduces consumption of the additive. In the case where an identical supply source of the plating solution (reservoir) is used to supply and circulate the plating solution to the cathode chamber and the anode chamber, circulation of the plating solution on the anode side in the course of plating causes the expensive additive to be continuously degraded (consumed) in the anode chamber. The configuration of supplying the plating solution only for the purpose of filling the anode chamber and of not circulating the plating solution in the anode chamber reduces consumption of the additive.

[6] According to one aspect, the method of the above aspect may further comprise introducing a plating solution of an identical composition to the anode chamber and to the cathode chamber.

The configuration of this aspect introduces the plating solution of the identical composition to the anode chamber and to the cathode chamber. This simplifies the configuration for supplying the plating solution.

[7] According to one aspect, in the method of the above aspect, the introducing the plating solution may comprise introducing the plating solution of the identical composition from an identical plating solution supply source to the anode chamber and to the cathode chamber.

The configuration of this aspect introduces the plating solution of the identical composition from the identical plating solution supply source to the anode chamber and to the cathode chamber. This simplifies the arrangement of flow paths to be connected with the anode chamber.

[8] According to one aspect, in the method of the above aspect, the anode chamber may be selectively connected with one of the plating solution supply source and a supply source of the pure water or the electrolytic solution.

The configuration of this aspect further simplifies the arrangement of flow paths that are to be connected with the anode chamber.

[9] According to one aspect, the method of the above aspect may further comprise using a concentration sensor and/or an electric conductivity sensor to detect a concentration and/or an electric conductivity in the anode chamber; and giving an alarm, based on a result of determination of whether the concentration and/or the electric conductivity reaches a predetermined reference value.

The configuration of this aspect enables lowering of the liquid level to be checked via the concentration and/or the electric conductivity of the plating solution, in the case of a rise of the concentration and/or the electric conductivity of the plating solution due to evaporation of water included in the plating solution in the anode chamber. In other words, this configuration allows for double monitoring of the liquid level, i.e., monitoring of the liquid level by the concentration sensor and/or the electric conductivity sensor in addition to monitoring of the liquid level by the liquid level sensor. For example, in the event of a failure of the liquid level sensor, an abnormality of the liquid level may be detected by the concentration sensor and/or the electric conductivity sensor. This enhances the redundancy in the control of liquid level management in the anode chamber.

[10] According to one aspect, in the method of the above aspect, the supplying the pure water or the electrolytic solution may comprise supplying the pure water or the electrolytic solution to the anode chamber, based on an output of the liquid level sensor, after completion of a plating process of a substrate.

The configuration of this aspect suppresses complication of the control in the course of the plating process.

[11] According to one aspect, in the method of the above aspect, the supplying the pure water or the electrolytic solution may comprise supplying the pure water to the anode chamber when it is determined that the liquid level of the plating solution in the anode chamber is lower than the predetermined height.

The configuration of this aspect supplies pure water corresponding to a decrease in the anode chamber and thereby suppresses or prevent a change in concentration of the plating solution in the anode chamber. This configuration also reduces the cost of the liquid to be supplied.

[12] According to one aspect, there is provided an apparatus for plating, comprising: a substrate holder configured to hold a substrate; an anode placed to be opposed to the substrate; a barrier membrane placed to be brought into close contact with an upper face of the anode; a plating tank configured to store a plating solution therein, parted by the barrier membrane into a cathode chamber where the substrate is placed and an anode chamber where the anode is placed, and provided with an exhaust path that communicates with the anode chamber and that is configured to discharge bubbles from the anode chamber to outside of the plating tank; a liquid level sensor placed in the exhaust path of the plating tank and configured to detect whether a liquid level of the plating solution in the exhaust path is lower than a predetermined height; and a control device configured to supply pure water or an electrolytic solution to the anode chamber, in response to a detection of the liquid level sensor that the liquid level of the plating solution in the exhaust path is lower than the predetermined height.

The configuration of this aspect has similar functions and advantageous effects to those described above with regard to the aspect [1], Although the embodiments of the present invention have been described based on some examples, the embodiments of the invention described above are presented to facilitate understanding of the present invention, and do not limit the present invention. The present invention can be altered and improved without departing from the subject matter of the present invention, and it is needless to say that the present invention includes equivalents thereof. In addition, it is possible to arbitrarily combine or omit the embodiments and the modifications described above and it is also possible to arbitrarily combine or omit respective constituent elements described in the claims and the specification in a range where at least a part of the above-mentioned problem can be solved or a range where at least a part of the effect is exhibited.

The entire disclosures of U.S. Patent Application Publication No. 2020-0017989 (PTL 1) and International Patent Application No. PCT/JP2022/016809 filed on Mar. 31, 2022 including the specification, claims, drawings and abstract are incorporated herein by reference in their entireties.

REFERENCE SIGNS LIST

10 plating tank
10*a* inner tank
10*b* outer tank
11 exhaust path
11A overflow path
12 liquid level sensor
13 concentration sensor (electric conductivity sensor)
20 overflow tank
31 substrate holder
41 anode
41A through hole
42 anode holder
43 anode mask
51 resistor
61 bubble
71 barrier membrane
72 retainer plate
72A through hole
74 fastening member
75 seal
80 circulation path
81 reservoir tank
82-85 flow paths
86 pump
87 filter
88 valve
89 valve
90 liquid supply path
91 liquid supply source
92 flow path
93 valve
95 flow path
400 plating module
Ca anode chamber
Cc cathode chamber
OFa overflow surface
OFc overflow surface
Sa, Sc liquid surfaces of levels

The invention claimed is:

1. A method of liquid management in an anode chamber, the method comprising:

providing a plating tank that comprises an anode; a barrier membrane placed to come into contact with or to be brought into close contact with an upper face of the anode; a cathode chamber on an upper side and an anode chamber on a lower side parted by the barrier membrane; and an exhaust path provided to communicate with the anode chamber and configured to discharge bubbles from the anode chamber to outside of the plating tank;

storing a plating solution in the anode chamber and in the cathode chamber, such that a liquid level of the plating solution in the exhaust path that is a liquid level of the plating solution in the anode chamber is lower than a liquid level of the plating solution in the cathode chamber;

determining whether the liquid level of the plating solution in the exhaust path is lower than a predetermined height, based on an output of a liquid level sensor placed in the exhaust path; and supplying pure water or an electrolytic solution to the anode chamber, when it is determined that the liquid level of the plating solution in the exhaust path is lower than the predetermined height.

2. The method according to claim 1, wherein the storing the plating solution comprises storing the plating solution in the anode chamber, such that the liquid level of the plating solution in the anode chamber is lower than an overflow height of the plating solution that overflows from the anode chamber.

3. The method according to claim 1, wherein the supplying the pure water or the electrolytic solution comprises supplying the pure water or the electrolytic solution to the anode chamber, such that the liquid level of the plating solution in the anode chamber is lower than an overflow height of the plating solution that overflows from the anode chamber.

4. The method according to claim 1, further comprising:

when the liquid level of the plating solution in the anode chamber is raised, causing the plating solution in the anode chamber to overflow at a height lower than an overflow height of the plating solution in the cathode chamber.

5. The method according to claim 1, further comprising:

circulating the plating solution in the cathode chamber without circulating the plating solution in the anode chamber.

6. The method according to claim 1, further comprising:

introducing a plating solution of an identical composition to the anode chamber and to the cathode chamber.

7. The method according to claim 6, wherein the introducing the plating solution comprises introducing the plating solution of the identical composition from an identical plating solution supply source to the anode chamber and to the cathode chamber.

8. The method according to claim 7, wherein the anode chamber is selectively connected with one of the plating solution supply source and a supply source of the pure water or the electrolytic solution.

9. The method according to claim 1, further comprising:

using a concentration sensor and/or an electric conductivity sensor to detect a concentration and/or an electric conductivity in the anode chamber; and giving an alarm, based on a result of determination of whether the concentration and/or the electric conductivity reaches a predetermined reference value.

10. The method according to claim 1, wherein the supplying the pure water or the electrolytic solution comprises supplying the pure water or the electrolytic solution to the anode chamber, based on an output of the liquid level sensor, after completion of a plating process of a substrate.

11. The method according to claim 1, wherein the supplying the pure water or the electrolytic solution comprises supplying the pure water to the anode chamber when it is determined that the liquid level of the plating solution in the anode chamber is lower than the predetermined height.

* * * * *